United States Patent [19]

Keller

[11] Patent Number: 5,045,087

[45] **Date of Patent: * Sep. 3, 1991**

[54] STABILIZED SUSPENSIONS OF CARBON OR CARBONACEOUS FUEL PARTICLES IN WATER

[75] Inventor: Leonard J. Keller, Dallas, Tex.

[73] Assignee: The Keller Corporation, Bonham, Tex.

[ * ] Notice: The portion of the term of this patent subsequent to Dec. 3, 2006 has been disclaimed.

[21] Appl. No.: 158,391

[22] Filed: Feb. 22, 1988

Related U.S. Application Data

[63] Continuation of Ser. No. 14,980, Feb. 17, 1987, abandoned, which is a continuation of Ser. No. 892,919, Sep. 4, 1986, abandoned, which is a continuation of Ser. No. 180,448, Sep. 22, 1980, abandoned, which is a continuation of Ser. No. 119,756, Feb. 8, 1980, abandoned, which is a continuation of Ser. No. 953,498, Oct. 23, 1978, abandoned.

[51] Int. Cl.[5] ..... C10L 1/32

[52] U.S. Cl. ..... 44/53; 44/56; 252/363.5

[58] Field of Search ..... 44/53, 56

[56] References Cited

U.S. PATENT DOCUMENTS

| | | | |
|---|---|---|---|
| 3,996,026 | 12/1976 | Cole | 44/51 |
| 4,045,092 | 8/1977 | Keller | 44/51 |
| 4,089,657 | 5/1978 | Keller | 44/51 |

*Primary Examiner*—Jacqueline V. Howard

*Attorney, Agent, or Firm*—James C. Fails; Arthur F. Zobal; Geoffrey A. Mantooth

[57] ABSTRACT

A method of preparing a stabilized or partially stabilized suspension of particles of carbon or of carbonaceous fuel materials in water characterized by comminuting coal (or other carbonaceous material) to form predetermined sized particles and coating the particles with at least a partial external coating of attached alcohol molecules of alcohols having from one to four (1 to 4) carbon atoms and thereafter admixing the alcohol coated particles with water to form the substantially uniform suspensoid of high solids content for use as a fuel for direct combustion, or as a feedstock for atmospheric pressure gasifiers or for pressurized gasifiers, or as a transport fluid to facilitate transportation of carbonaceous fuels by pipeline or by other fluid handling means. The suspensoid can contain up to 75 percent by weight coal, but contains less than 8 percent by weight alcohol. In a preferred embodiment, coal particles are first compacted and then comminuted to the predetermined particle size range to form an abundance of platey, lenticular, irregular and angular particles for forming a mechanically stabilized suspensoid, after coating with alcohol molecules and mixing with water, that exhibits the property of shear thinning so as to be pumpable or flowable with a lower apparent viscosity than the at-rest viscosity of the suspensoid fluid. Also disclosed are specific details of the method and preferred embodiments, including the composition of the suspensoid materials.

17 Claims, No Drawings

STABILIZED SUSPENSIONS OF CARBON OR CARBONACEOUS FUEL PARTICLES IN WATER

This is a continuation of application Ser. No. 014,980 filed Feb. 17, 1987, which is a continuation of Ser. No. 892,919 filed Sept. 4, 1986, which is a continuation of Ser. No. 180,448 filed Sept. 22, 1980, which is a continuation of Ser. No. 119,756 filed Feb. 8, 1980, which is a continuation of Ser. No. 953,498 filed Oct. 23, 1978, all abandoned.

BACKGROUND OF THE INVENTION

1. Field of the Invention:

This invention relates to a fuel, gasifier feedstock material, or transportation fluid, methods of preparing the economical material, and its composition. More particularly, this invention relates to methods of preparing a combustible, pumpable and readily transportable fluid admixture of coal or other carbonaceous material particles in water to facilitate the processing, transportation and utilization of the fossil carbonaceous resource materials, where are so abundantly available, as well as the carbon byproducts of industry.

2. Description of the Prior Art:

In my recently issued U.S. Pat. No. 4,089,657 "Stabilized Suspension of Carbon in Hydrocarbon Fuel and Method of Preparation", references are cited which emphasize the needs for new technologies which can provide economical power and energy while satisfying ecological considerations and improving environmental conditions. The problems associated with the recent "energy shortage" or "energy dilemma" are now reasonably well known, and are dramatized by trippling or quadrupling of world petroleum prices end domestic natural gas prices.

In my hereinabove referenced U.S. Pat. No. 4,089,657, the difficulties encountered in previous conventional methods of transportation for the carbonaceous fuels were discussed, i.e. rail shipment of coal and lignite and water slurry pipeline transportation of coal. Difficulties encountered in utilization of fuels delivered by conventional means were also discussed, as well as difficulties encountered in attempts to transport and use mixtures or slurries of pulverized coal and hydrocarbon oils. The referenced Patent provided simple, effective and economically feasible answers to the problems which have plagued the field of coal-oil mixtures technology. However, the stabilized suspensold fuels provided; even though they are more easily produced, handled, transported, stored and utilized, and have higher carbon to hydrocarbon ratios than any prior art technologies could provide; are still dependent on availability, and to some extent on prices of hydrocarbon oils.

Since the so-called "energy dilemma" is basically only a reflection of the fact that most of the economically recoverable hydrocarbon resources of the world have been discovered and rapidly exploited or wasted (i.e. natural gas flared to accelerate immediate profits on crude oil), there still remains most urgent need for fuel technologies which are completely independent of any reliance on hydrocarbon natural resources.

The technologies provided by my U.S. Pat. No. 4,045,092, "Fuel Composition and Method of Manufacture", allow economical production, transportation and utilization of fuels made from coal or lignite, which are, or can be, completely independent of any reliance on hydrocarbon resources. However, the rate at which these new technologies can be implemented depends to some degree on the rate at which new capital-intensive coal conversion plants can be built and put into operation to produce alcohols from coal or lignite, water, and air (oxygen). Consequently, there is urgent near-term need for other methods or technology which can facilitate the production, transportation and utilization of the carbonaceous fossil fuels, and which are essentially independent of the requirement for any hydrocarbon materials in their production or manufacture.

There is also great need for technologies which can produce materials which are, in turn, particularly applicable to the coal gasification or carbon gasification processes which can provide intermediate fuel-value (BTU) fuel gas, or synthesis gas (carbon monoxide and hydrogen mixture) for conversion to methanol, fuel grade alcohols (i.e. Methyl-fuel), ammonia, or methane (synthetic natural gas). Specifically, there is need for technologies which can provide an effective, economical means for feeding pulverized carbon materials or pulverized carbonaceous materials into pressurized gasifiers operating at pressures from a few hundred pounds per square inch to pressures of a few thousand pounds per square inch or more.

This Invention proposes to provide such technologies as are considered urgently needed hereinabove.

SUMMARY OF THE INVENTION

It is one objective of this invention to provide a fuel composition of principally carbonaceous fuel particulate materials coated or partially coated with alcohol molecules and suspended in water in basically stabilized state to form a shear-thinning suspensoid fluid with non-Newtonian flow properties which allow it to be stored in a relatively shear-resistant, or high-viscosity, state and pumped or flowed in the low-effective-viscosity state as a fluid rather than as a slurry, to facilitate pipeline and other bulk fluid transportation means as well as local storage, handling and pumping of the suspensoid materials.

Another objective of this invention is to provide a fuel composition as described above which has a sufficiently high percentage of carbonaceous fuel materials that this new fuel, being inherently supplemented by the relatively small percentage of alcohols present, can provide a readily combustible fuel for combustion furnaces, boiler fireboxes, rotary kilns and low-pressure gasifiers, even though it may contain from twenty to forty percent water by weight.

Still another objective of this invention is to provide a means for the introduction of carbonaceous fuel materials into pressurized combustors for Brayton cycle engines, (i.e. coal-burning gas turbines), and into pressurized gasifiers for production of low-BTU and intermediate-BTU fuel gas or for production of synthesis gas (carbon monoxide and hydrogen) for subsequent conversion to methanol, fuel-grade alcohols, ammonia, methane (synthetic pipeline gas) or hydrogen.

These and other objectives will become apparent from the descriptive matter hereinafter.

In accordance with this invention, there is provided a method of preparing a suspensoid fuel that includes a plurality of steps. First, the coal is mined and comminuted to form particles of the predetermined optimum particle-size range and, preferably, by means which effect platey, lenticular, irregular and angular particles ideal for forming stabilized shear-thinning suspensoid fluids. Second, the sized coal particles are exposed to alcohol such that at least most of the exposed surfaces of the coal particles are coated with attached alcohol molecules. The coating may be by one or a combination of the conventional alcohols which contain from one to four atoms of carbon per molecule. Consequently, alcohol-coated, carbonaceous fuel particles are formed. Third, the alcohol-coated, carbonaceous fuel particles are admixed with water in the predetermined desired or optimum amount, or ratio, and subjected to shearing forces (stirring or blending) of appropriate intensity and for an acceptable period of time to stabilize the suspensoid. The suspensoid contains less than 8 percent by weight alcohols, preferably less than 3–4 percent by weight alcohol.

In a specific and preferred embodiment, the coal is converted into a partially de-ashed, partially de-sulphurized, highly-reactive particulate carbonaceous-hydrocarbonaceous fuel, called CHC Fuel, prior to coating the particles with alcohol and admixing with water. The CHC Fuel material has a lower density than the pulverized coal described hereinabove, and the material is also much more reactive (combustible) than the pulverized coal. Generally, CHC Fuel will also consist of much smaller and more ideally shaped particles. Consequently, the suspensoid fluids formed will be more stable, exhibit lower effective viscosities in pumping and may accomodate higher concentrations of carbonaceous material with less alcohol required (i.e. 65 to 75 percent carbonaceous particulate material with less than 1 or 2 percent alcohol).

DESCRIPTION OF PREFERRED EMBODIMENTS

The method of this invention has been outlined hereinbefore. The specific steps and materials are described immediately hereinafter in order to insure a complete understanding of the invention.

The coal that is employed in this invention may be of any of the commercially available coals, ranging from the relatively pure and high carbon content anthracite coal through the bituminous coals and including the less desirable soft coals, lignites and the like.

The mining and preparation of coal is described at some length in Kirk-Othmer ENCYCLOPEDIA OF CHEMICAL TECHNOLOGY, Second Edition, Anthony Standen, Editor, Inter-Science Publications, New York, 1969, Vol. 5, pp. 606–676; and that descriptive matter is incorporated herein by reference. The coal is mined from a coal mine by either strip or underground methods, as appropriate to the respective deposit. These methods are conventional and are described on page 660 of the aforementioned Kirk-Othmer ENCYCLOPEDIA.

One advantage of this invention is that it can employ the fines of the coal that were formerly discarded because of customer objections to fine coal and the loss of coal dust in loading and unloading. The exact nature of the coals in coal deposits in various states have not been completely characterized even though the deposits are known to be extensive. If a coal has a large amount of fusinite, it will be extremely friable, and will tend to concentrate in the fine size ranges during its preparation. This is helpful in practicing this invention, since the fines can be employed directly in making the alcohol-coated coal particles in admixture, or suspension, with water. This reduces the amount of additional work required in pulverizing, or comminuting the coal for forming the suspensoid, or admixture with water. Similarly, any appreciable amounts of vitrinite will readily break into fine sizes of less than one millimeter to reduce the work of additional size reduction and comminution required to effect the desired range of particle sizes. As is known, in making the fine particles, the amount of work is indicated by a Hargrove Index. Specifically, a low Hargrove Index indicates that more energy will be necessary in the pulverizing mill to create the coal powder. It is understood that many of the coals, such as the Alaskan coal, have a relatively high Hargrove Index; and, hence, require relatively lopower to pulverize.

The details of preparing the fine particles are contained in my aforementioned U.S. Pat. Nos. 4,045,092 and 4,030,893. As described, particularly in the latter, the coal particles are prepared to have the suitable size range. Specifically, they are all −8 (minus eight) mesh, U.S. standard screen size with the majority of the particles being −100 mesh (minus one hundred mesh) size. If desired, the majority of the particles may be of −200 (minus two hundred) mesh size. As is recognized, the designation of minus means that all of the particles pass through the indicated size screen. Preferably, the coal particles are of sizes which would have a settling velocity of less than about two and one half centimeters per second in water.

The coals, particularly the lower quality coals, frequently have a substantial quantity of ash forming materials and the like therein that form difficultly combustible fuel and add to the problem of burning the coal by producing large quantities of slag, ash or the like in the combustion chamber. Also, these low quality coals frequently have high percentages of sulphur or sulphur-containing compounds that cause pollutants when oxidized or burned. It is preferred that the coal be ridded of these undesirable constituents by servicable processes such as described in my U.S. Pat. No. 4,030,893 entitled "Method of Preparing Low-Sulphur, Low-Ash Fuel", and in my co-pending application Ser. No. 853,031, now issued, U.S. Pat. No. 4,146,366, entitled "Improved Method of Removing Gangue Materials from Coal", before being employed in this invention. If the coal particles are treated by the delineated processes and, low-density, high-reactivity carbonaceous fuel particles are formed, they are more readily oxidized during combustion with substantially reduced pollution. Moreover, these highly-reactive carbonaceous particles may be burned in difficult combustion applications such as even in internal combustion engines or the like because of their enhanced reactivity. The name "CHC Fuel" has been applied to designate this unique type of pulverulent carbonaceous material.

Specifically, in a particularly preferred embodiment the CHC Fuel particles are in the form of low-sulphur, low-ash small carbonaceous particles of a density less than conventional coal. These unique coal-derived particles are described in detail, as well as the method of their preparation, in my U.S. Pat. No. 4,030,893, entitled "Method of Preparing Low-Sulphur, Low-Ash Fuel", and my co-pending application Ser. No. 935,351, entitled "Method of Producing Pulverulent Carbonaceous Fuel", filed Aug. 21, 1978 and allowed for issue, and are known as CHC Fuel. Since the descriptive matter of these references has been incorporated herein, a summary of the steps of providing the CHC Fuel will not be reiterated. Basically, the coals are processed and cleaned in alcohols and the alcohols and some other volatilizable materials are removed by various processes to provide the dry, low-density, particulate fuel, called CHC Fuel. As economical fuel-grade mixture of alcohols is referred to herein as methyl fuel as a shorthand designation. As will become apparent hereinafter, the alcohols, or methyl fuel, includes predominantly methanol as a practical matter. The working of the coal particles in the presence of the methyl fuel dissolves water and other alcohol-soluble ingredients from the coal and activates and wets the surfaces of the coal particles. This step is apparently necessary to form a shear thinning slurry of coal and alcohol, called Methacoal, that is advantageous, described and claimed in my U.S. Pat. No. 4,045,092, referenced hereinabove. The Methacoal may then be used to produce CHC Fuel.

The CHC Fuel, in one embodiment at least, is formed into puffed, or expanded particles by the flashing of the alcohol from heated coal particles. These expanded particles have a lower density that approaches that of the water into which the coal-derived particles will be admixed. These light-weight CHC Fuel particles are themselves advantageous in forming a more nearly stable suspensoid, or admixture, of the particles in water, regardless of whether they are again coated with alcohol. As indicated hereinabove, improved results are effected when they are again coated with alcohols.

Herein, the term, "alcohols" is employed to denote the alcohols 1–4 carbon atoms, inclusive. As is recognized these alcohols include methanol, ethanol, propanol and butanol, and mixtures thereof. As a practical matter, these alcohols will generally include methanol. These alcohols may range in purity from the substantially pure state to the crude alcohol mixtures that are produced by the gasification of coal followed by a "methanol", or alcohol, catalytic synthesis operation. These latter types of alcohols are frequently referred to in the art as "methyl fuel". The methyl fuel may be produced at a site closely adjacent the mined coal or it may be transported into the area in which are prepared the alcohol-coated coal particles. In my hereinbefore referenced U.S. Pat. No. 4,045,092, I have described the gasification of coal and the subsequent alcohol production from the synthesis gas produced thereby. That descriptive matter is embodied herein by reference and need not be duplicated herein. The alcohols, however may be produced from natural gas or other feedstock materials, or from suspensoid fuels of this invention. The alcohols are then used to coat at least the surface areas of the small particles of carbonaceous fuel before they are admixed with water to produce the suspensoid of this invention.

Pulverized coal may be used to form the suspensoid fuels of this invention, instead of using the CHC Fuel materials. In operation, the coal is ground and pulverized to small particle sizes by conventional means. As indicated hereinabove, it is preferred that the coal particles have a platey structure with an abundance of platey, lenticular and angular particles for forming a shear thinning suspensoid with water.

There are various means available for effecting the size reduction and controlling the characteristics of the particulate coal to insure a maximum production of these elongate, platey and irregularly shaped particles, including a wide variety of particle shapes to better effect sheer thinning thixotropy of the resulting suspensoids. One satisfactory embodiment is illustrated and described in my U.S. Pat. No. 4,045,092. Therein the coal is first crushed. The resulting comminuted coal is sent to a roll compactor. The roll compactor then forms a planar board-like slab of coal while imposing great internal shear and tearing forces during compaction and consequent induced solids flow. The coal particles are essentially reformed in that all of the original parting planes, intersticial openings, individual particles and parting interfaces are destroyed and re-oriented. The re-orienting has a tendency to form schistose-like material with substantially parallel planes. The slabs of coal are then sent from the rail compactor to a shredder. In the shredder, the slabs of coal are pulverized to produce difficult types of particles of coal, as compared with the original coal. Specifically, the individual particles will be predominantly elongate, platey, lenticular, and irregular, as is desired to effect the shear thinning suspensoid. Typically, a shredder may comprise a hammermill or cage impactor to form the desired particles, these particles may be used as so formed to produce the suspensoid fuel of this invention.

The pulverized coal or CHC Fuel particles are exposed to alcohol such that at least the exposed surfaces of the particles are coated with the attached alcohol molecules. Thus it can be seen that only minor amounts of alcohol is necessary. The amount of alcohol that is necessary will be less than 8% by weight of the total weight of the suspensoid including the solid particles in the water. Preferably, the amount of alcohol is less than 3–4% by weight of the suspensoid. For example only about 1 to 2% by weight of alcohol should be adequate to enable coating the coal particles sufficiently to form the shear thinning suspensoid of this invention.

The step of exposing the particles of coal to the alcohol may be done in preparing the CHC Fuel particles as denoted hereinbefore. On the other hand, the pulverized coal or CHC Fuel particles may be exposed to alcohol vapors at a temperature just high enough to minimize condensation. Specifically, the coal particles are passed to a closed rotary cylinder having lifters therein and to which are sent the alcohol vapors, alone or in combination with an inert gas such as carbon dioxide. The coal particles are lifted and dropped through the vapors as the cylinder rotates.

In order to prevent a vacuum, as the alcohol vapor is adsorbed onto the coal particles and condensed if the coal particles are cooler than the alcohol condensation temperature, the inert gas is fed to the closed type rotary cylinder device. Other types of reaction vessel such as fluidized-bed devices may be used. Any of the conventional inert gases, such as carbon dioxide, nitrogen, helium, neon, argon and the like, may be employed for this purpose. Of these, carbon dioxide is particularly satisfactory. Although it may tend to be adsorbed, it is readily replaced by the alcohol as a surface molecular coating. Moreover, while no experiments have been carried out to verify this, there appears to be serendipitous benefits from using carbon dioxide. The particles that have been coated with the alcohol in the presence of the carbon dioxide appear to be even more effective in forming the shear thinning suspensoids in water, than when exposed to the alcohol alone as by alternate processes such as delineated hereinafter.

The alcohol-coal particles may be added to the water in any proportion desired. Ordinarily, it is advantageous to employ as high a concentration of solids, or coal particles, as possible in the water, since the water represents potential energy loss in vaporizing and either returning or disposing of it. In the prior art heretofore, only about 50% by weight of solids has been possible and then only at cost in pumping and required dilution such as described in U.S. Pat. No. 3,996,026 to form a pumpable slurry. One of the advantages of this invention is that this invention forms a substantially uniform, shear thinning suspensoid that is different from a slurry and can be pumped with relatively low power consumption compared to slurries. Specifically, concentrations above 50 to 60% by weight solids can be employed in this invention. In fact, when concentrations of 60–80% by weight of solids are employed the suspensoid is more nearly uniformly mixed throughout the pumping operation and have reduced tendency for the solids to settle.

As implied from the foregoing, the remainder of the suspensoid is water. The water may be relatively pure water such as rain water, lake water or the like. On the other hand, it can be relatively high in soluble materials such as brines or the like. Ordinarily, it is preferred to employ water that has noncontaminating constituents when subjected to evaporation or the like in order to reduce the ashing problem when the fuel is burned.

In any event, the alcohol-coated coal particles are then added to the water in the desired concentration. The resulting admixture of the alcohol-coated particulate coal or CHC Fuel and water may be sent to storage or pumped continuously. If merely slurried together, the particulate may comprise less than fifty percent by weight of the admixture. When it is desired to produce a shear thinning liquid-solid suspensoid of the alcohol-coated particles in water, the percentage of the solid particles may be increased into the range of 50–80 percent. Preferably, the suspensoid contains 60–80 percent solids to effect good shear thinning rheology. As indicated hereinbefore, the shear thinning rheology allows the liquid-solid suspensoid to be pumped at a much lower viscosity. The mixture is subjected to controlled intensity stirring or blending action to further stabilize the suspension and prevent compacted settling.

The admixture of the alcohol-coated coal-derived particles in water as a shear thinning liquid-solid suspensoid, is transported by a suitable means to a destination. The transportation may be by any of the conventional means, such as, pipeline, ship, barge, railroad tank car, tank trucks and the like. The shear thinning liquid-solid suspensoid of the alcohol-coated particles in water is particularly amenable to being moved by hydraulic transport, such as being pumped through a pipeline. It may be pumped without any tendency for the coal particles to pile up as in the conventional, or prior art type of slurry, such as coal-water slurries. If the pipeline is sufficiently long, the suspensoid may be run into storage tanks or from pump to pump and have its pressure elevated by suitable booster pumps, as with conventional liquid pumping technology. Centrifugal pumps with conventional wear resistant coatings, such as silicone carbide or Stellite, on the impellers may be employed advantageously in the pumping means for pumping the suspensoid through the pipeline. Of course, positive displacement pumps such as are conventionally employed in pumping drilling fluid, coal-water slurry or cement slurry, may be employed. The pipeline may be any of the conventional pipelines such as by welding wrought from pipe together in accordance with conventional engineering standards and criteria. Suitable surge tanks and pumping means are connected with the pipeline by appropriate valving.

A destination may comprise a using facility or a storage facility. The destination may, in fact, comprise a combination of these as for providing shipping facilities for loading ships, railcars or trucks for shipment to more distant locales or other parts of the world. Ordinarily, it is considered advantageous in the conventional United States, or the North American continent, to employ pipeline to a destination, since the hydraulic transport is the most economical method of transportation.

At the ultimate destination, the liquid-solid suspensoid of the alcohol-coated coal-derived particles in water may be employed as a direct combustion fuel for heat, for power boilers such as utility power plant, or for a process steam generation. This invention is most advantageous when the using destination will employ the combination as a fuel for some sort of work producing engine, such as a power plant or the like. In such an environment, the coal particles, as well as their surface coating of alcohol, combust readily and serve to provide a much improved fuel compared to pulverized coal at the same moisture content, i.e. from coal-water slurry systems.

The suspensoid fluid fuels of this invention also provide an economical, efficient and practical means for feeding carbon feedstock and water into pressurized combustion chambers for Brayton cycle engines, and into pressurized gasifiers for production of synthesis gas. Particularly, these fluids may be most useful in allowing the hydraulic pumping of carbon feedstock and water in the optimum (stochiometric) ratios into high-pressure gasification reactors.

In another embodiment of this invention, coal is first treated as delineated in the aforementioned U.S. Pat. No. 4,045,092 to produce the dry, powdered, low-ash, low-sulphur particulate carbon-hydrocarbon fuel called CHC Fuel. One advantage of this invention is that the CHC Fuel used need not be completely separated from the alcohols. If the CHC fuel has been completely processed, it is preferably again exposed to at least sufficient alcohol to form the alcohol coating of the surfaces. As indicated hereinbefore, however, the last stage of separation from the alcohol may not be employed, since the alcohol coating is beneficial in the process of this invention. On the other hand, the puffed or expanded coal particles have been found to be uniquely advantageous, since they appear to be in highly reactive state. Moreover, they may be readily coated, as by exposing to vapors of the alcohol.

In any event, as described hereinabove, the alcohol coated CHC Fuel particulate is then mixed with water in whatever proportion is required, but generally from 50 percent to 75 percent CHC Fuel, depending on the nature of the specific CHC Fuel material. The resulting mixture is subjected to at least minimal shear forces by a stirring or blending type agitation, as implied hereinbefore. Conventional blending or stirring devices may be used.

Suspensions containing relatively low concentrations of particulate fuel, i.e. 50% or so, may require gentle stirring during storage to maintain uniformity or homogeneity. With higher concentrations of particulate materials, the homogeneous admixture remains stable and settling of the solid particles does not occur to an extent sufficient to present any engineering problems. Such uniformity of dispersion, or homogeneity, has not been achieved in the prior art attempts to produce coal-in-water slurry mixtures. There is a limit, however, to the maximum percentage of the particulate solids for a particular carbonaceous particulate material to allow maintaining a pumpable effective viscosity. These limits are a function of the specific nature of the particulate material and the amount of alcohol used for coating. The maximum percentage of the particulate may be determined experimentally for each specific carbonaceous material and amount of alcohol provided (normally from zero to five percent of the total weight of the suspensoid as alcohols).

The use of alcohol vapor, alone or in conjunction with an inert gas has been described hereinbefore for coating the particles of coal, including the CHC Fuel particles, before admixing with water. If desired, the pressure of the vessel in which the particles are being coated with alcohol may be maintained by heating the coal prior to feeding it to the reactor. The coal particles should be heated to a temperature about equal to the temperature of the alcohol boiling point. Additional heat may be supplied to the reactor vessel for limiting the alcohol vapor addition to control the pressure. The objective, of course, is to simultaneously control the pressure of the reactor during the coating of the particles and to control the amount of alcohol needed to accomplish the coating without saturating the carbonaceous particles throughout. As indicated hereinafter, economics may change such that the coal particles may desirably be saturated with the alcohol.

As indicated, at the present time, the alcohols are much more expensive than the aqueous solution portion for use in this invention. Consequently, it is economically advantageous to employ merely a surface coating of the alcohol. This situation may be changed in the future, since new technology promises to effect reduction in the cost of fuel-grade alcohols. When the relative costs and availability of alcohols in sufficient quantities will permit, the coal particles may be saturated with the alcohol molecules and the same uniquely beneficial results obtained as delineated hereinbefore. Specifically, the alcohol-saturated coal-derived particles, whether they be native coal or the CHC Fuel, will still effect the same shear thinning type of suspensoid to obviate the disadvantages of the prior art slurries or expensive emulsions.

The following example illustrates an embodiment of this invention which has been found satisfactory.

EXAMPLE

A sample portion of CHC Fuel made from dry Wyoming coal was treated in a heated glass rotating drum with lifters to produce the alcohol-coated carbonaceous fuel particulate material. Alcohol vapors were passed through an insulated tube into the rotating drum from a boiling vessel, after the drum was purged with carbon dioxide gas. Sufficient alcohol was adsorbed to coat the surfaces of the particles. The CHC Fuel particles were then added to water to have 60 percent by weight of the alcohol-coated CHC Fuel particles in the resulting admixture. The admixture had only about 1–2 percent by weight alcohol.

The resulting admixture appeared to be a black mass of paste-like moistened solids. When subjected to shear, however, its viscosity became less and it was readily flowable, flowing like a liquid. When tested on suitable rheological resting apparatus, such as rotating cylinder, the liquid-solid suspensoid was demonstrated to be truly thixotropic and exhibit the shear thinning in which the shear stress decreased with time and with increasing shear.

A plurality of other compositions employing a variety of concentrations of either the alcohol-coated coal-derived fuel particles of CHC Fuel particles in water were employed. For any specific carbonaceous material there appears to be a definite and relatively narrow range of concentration (percentage of solids) wherein the fluid remains relatively stable and exhibits the shear thinning rheological characteristics. As the concentration is increased to the limits, the fluid becomes unyielding. If the fluid is diluted beyond some limit, it reverts to typical slurry form, and rapid settling of the heavier particles causes compaction and build-up of a dense unyielding substrate.

From the foregoing, it can be seen that this invention provides a technically feasible and an economically practical method for using coal or lignite resources to provide replacements for the petroliferous fuels in the transition period from using primarily the petroleum and natural gas fuels (which are rapidly approaching extinction) to the use of new energy fuels or alternate energy sources.

Having this described the invention, it will be understood that such description has been given by way of illustration and example and not by way of limitation, reference for the latter purpose being had to the appended claims.

What is claimed is:

1. A method of preparing a fluid fuel comprising the steps of: firstly a. comminuting coal to form particles of a predetermined size range, and b. coating the exposed surfaces of the particles of said coal with an alcohol selected from the class consisting of methanol, ethanol, propanol, butanol and mixtures thereof to impart buoyancy to coal particles and form alcohol-coated coal particles such that said alcohol-coated coal particles can be admixed with water to form a stable, uniform admixture that in sufficiently high proportion coal particles forms a shear thinning suspensoid that can be pumped at a lower apparent viscosity than its at-rest viscosity and that can be transported by hydraulic transport over a long distance readily, maintaining the alcohol-coated coal particles in suspension so they do not fall out in hydraulic transport even over long distances; the amount of alcohol being employed being less than 8% by weight of the final admixture in water; and, thereafter, c. admixing said alcohol-coated coal particles with water to form a substantially stable, uniform admixture thereof and to form a high carbon content fuel that can be readily transported by hydraulic transport and the like to a using destination and burned with acceptable high efficiency.

2. The method of claim 1 wherein said coal is first compacted and then comminuted to said predetermined size range so as to form an abundance of platey, lenticular, irregular and angular particles for forming, in combination with the alcohol coating, a stabilized suspensoid at high solids concentration greater than 50 percent by weight solids that is shear thinning so as to be pumpable at a lower apparent viscosity than its at rest viscosity.

3. The method of claim 1 wherein said alcohol comprises methanol.

4. The method of claim 1 wherein said coating of step b. is effected by passing said coal particles through a heated vessel in which is maintained an atmosphere of vapors of said alcohol.

5. The method of claim 4 wherein an inert gas is employed in said vessel in conjunction with said vapors of said alcohol so as to prevent the pressure therewith from becoming less than atmospheric as said alcohol vapors are adsorbed on to said surfaces of said coal particles.

6. The method of said claim 1 wherein said particles of coal are saturated with said alcohol before being admixed with said water.

7. The method of claim 1 wherein said alcohol is less than 4% by weight of said final admixture of alcohol-coated coal particles in water.

8. The method of claim 7 wherein said alcohol comprises less than 2% by weight of the final admixture of said alcohol-coated coal particles in water.

9. A fuel composition comprising substantially uniform admixture of water and alcohol-coated coal particles of −8 mesh particle size with a majority being of −100 mesh particle size; said coal particles having absorbed on their surfaces at least sufficient alcohol to cost the surface thereof to impart buoyancy and have the property of forming a stable uniform admixture of alcohol-coated coal particles in the water and in sufficiently high proportion to form a shear thinning suspensoid that can be prumped at a lower apparent viscosity than its at-rest viscosity; said alcohol having 1–4 carbon atoms, inclusive; and comprising less than 8% by weight of the final uniform admixture of water and alcohol-coated coal particles.

10. The fuel composition of claim 9 wherein said alcohol comprises less than 4% by weight of said final admixture of water and alcohol-coated coal particles.

11. The fuel composition of claim 9 comprising 63–75% by weight of said coal particles, less than 4% by weight of alcohol and at least sufficient alcohol to cost said coal particles before being admixed with water; and the remainder of water.

12. The fuel composition of claim 9 wherein said substantially uniform admixture consists essentially of sufficient alcohol-coated coal particles of required shape to form a shear thinning suspensoid that can be pumped through a pipeline with lower apparent viscosity than its at rest viscosity.

13. The fuel composition of claim 9 wherein said coal particles are lenticular, platey, and irregular and are present in a proportion in the range of 50–80 percent by weight.

14. The fuel composition of claim 9 wherein said coal particles comprise CHC fuel particles.

15. The fuel composition of claim 9 wherein said alcohol-coated particles comprise CHC fuel particles still saturated with alcohols from processing.

16. A method of preparing a fluid fuel comprising the steps of: firstly a. forming particles comprising carbon of −8 mesh size with a majority being of −100 mesh size; and b. coating at least the exposed surfaces of said particles of carbon with an alcohol containing 1–4 carbon atoms, inclusive such that said alcohol-coated coal particles can be admixed with water to form a stable, substantially uniform admixture thereof and, in sufficiently high proportion form a shear thinning suspensoid; said alcohol being employed in a proportion of less than 8% by weight of the final admixture of alcohol-coated coal carbon particles in water; and thereafter admixing said alcohol-coated carbon particles with water in a proportion to form a substantially stable, uniform admixture thereof and to form a high carbon content fuel that can be readily transported by hydraulic transport and the like, without having the alcohol-coated coal particles fall out of the water to form a pile-up of difficulty admixed solid particles, to a using destination and burned with acceptable high efficiency and energy output.

17. The method of claim 16 wherein said alcohol-coated carbon particles are admixed in a proportion greater 50 percent by weight and sufficient to form a shear thinning suspensoid that can be pumped at a lower apparent viscosity than its at rest viscosity and wherein said alcohol comprises less than 4% by weight of the final uniform admixture of said alcohol-coated carbon particles in said water.

* * * * *